United States Patent [19]

Lance et al.

[11] Patent Number: 4,498,757

[45] Date of Patent: Feb. 12, 1985

[54] DEMOUNTABLE, MODULAR TONER-FUSER ASSEMBLY FOR ELECTROGRAPHIC PRINT APPARATUS

[75] Inventors: Wayne E. Lance, Orlando; Wilson P. Rayfield, Longwood, both of Fla.

[73] Assignee: Burroughs Corporation, Detroit, Mich.

[21] Appl. No.: 409,023

[22] Filed: Aug. 17, 1982

[51] Int. Cl.[3] ..... G03G 15/20

[52] U.S. Cl. ..... 355/3 FU; 432/60; 219/216

[58] Field of Search ..... 355/3 FU, 14 FU; 219/216, 469, 470, 471; 432/60; 118/60

[56] References Cited

U.S. PATENT DOCUMENTS 3,973,844 10/1976 McCarroll ..... 355/3 FU 4,154,575 5/1979 Edwards et al. ..... 355/3 FU

*Primary Examiner*—A. T. Grimley

*Assistant Examiner*—J. Pendegrass

*Attorney, Agent, or Firm*—Carl Fissell, Jr.; Kevin R. Peterson

[57] ABSTRACT

A modular, demountable toner fuser assembly for electrographic printing/copying apparatus wherein oppositely disposed adjustable tensioning members are coupled to a dead center linkage such that a pair of confronting pressure rollers operably associated with the dead center linkage can be moved relative to one another so as to provide suitable fusing pressure while being automatically instantly separables in response to any exigency e.g. items jams, tearing, crumpled paper or other nonfeed conditions.

10 Claims, 10 Drawing Figures

164
162
168
106
170
160
96
102
94
138
188
146
136
190
22
52

DEMOUNTABLE, MODULAR TONER-FUSER ASSEMBLY FOR ELECTROGRAPHIC PRINT APPARATUS

BACKGROUND OF THE INVENTION

1. Field of the Invention

The present invention relates to electrophotographic apparatus and more specifically to a demountable, modular, toner fuser assembly utilizing both heat and pressure and having automatic means for applying and releasing such pressure to produce an image on sheet items.

2. Description of the Prior Art

Most, if not all, electro-photographic apparatus employ some method and mechanism for making the latent image produced by the electrographic device visible to the human eye. So called toning material is usually used which can be liquid or dry as the case may be, but in each type means must be employed to "fuse" the toner into the paper which is most often used to provide the fusible image carrier.

Liquid toner type fusers employ a radiant heater to dry the dispersed liquid prior to exiting the visible copy to the operator. Some dry toner fusers employ a thin film of silicone oil as a release agent for the fuser roller. This oily material tends to be quite messy and in many cases never really dries but often appears as a shiny surface after the paper has passed through the pressure rolls associated with such devices. In addition the oil sticks on the paper which tends to make the paper stick to other objects that it touches which is highly undesirable.

SUMMARY OF THE INVENTION

The present invention solves these and other associated problems in a new, novel and heretofore unobvious manner by providing a pair of dry silicone or teflon covered rollers in confronting, rolling contact with one of the two rollers rockably pivoted relative the other roller. A signal actuated overcenter or dead center cam and cam linkage operably connected to the pivoted roller in conjunction with an adjustable spring loading mechanism permits the two rollers to be biased together under a preset pressure while enabling the two to be automatically separated, for jams, apparatus stoppage as well as routine end-of-copy-run situations. Elongated fixed supports in conjunction with locating pins enable the modular fuser assembly to be withdrawn from the path of movement of the copier drum and the sheet items being printed or copied. A rockably mounted, arcuate paper guide is disposed adjacent to the "nip" of the two fuser rollers and acts to provide an exiting item throat so as to deflect both the sheet items and the heat radiated from the lower hot roller of the pair. A demountable heat deflector is located between the copy drum and the hot roller supported by a fixed U-shaped yolk. Rotative power is coupled to the fuser roller through a novel split coupling and signal actuated single revolution clutch permitting the modular fuser assembly to be dismounted from the base assembly without disrupting the driving mechanism. An optical paper timing sensor is located on the rockably mounted paper guide adjacent to the "nip" between the two fuser rollers.

DESCRIPTION OF THE PREFERRED EMBODIMENT

The modular, demountable, retractable fuser assembly embodying the present invention is seen in FIGS. 1–5 inclusive to comprise an upper backup horizontally elongated drive roller 10 and a lower elongated, heated idler roller 12. The exterior surface of each of these two rollers is or may be covered, coated or overlayed with dielectric heat resistant material such for example as teflon or silicone, as will be described later on herein.

Figures 1, 1A:
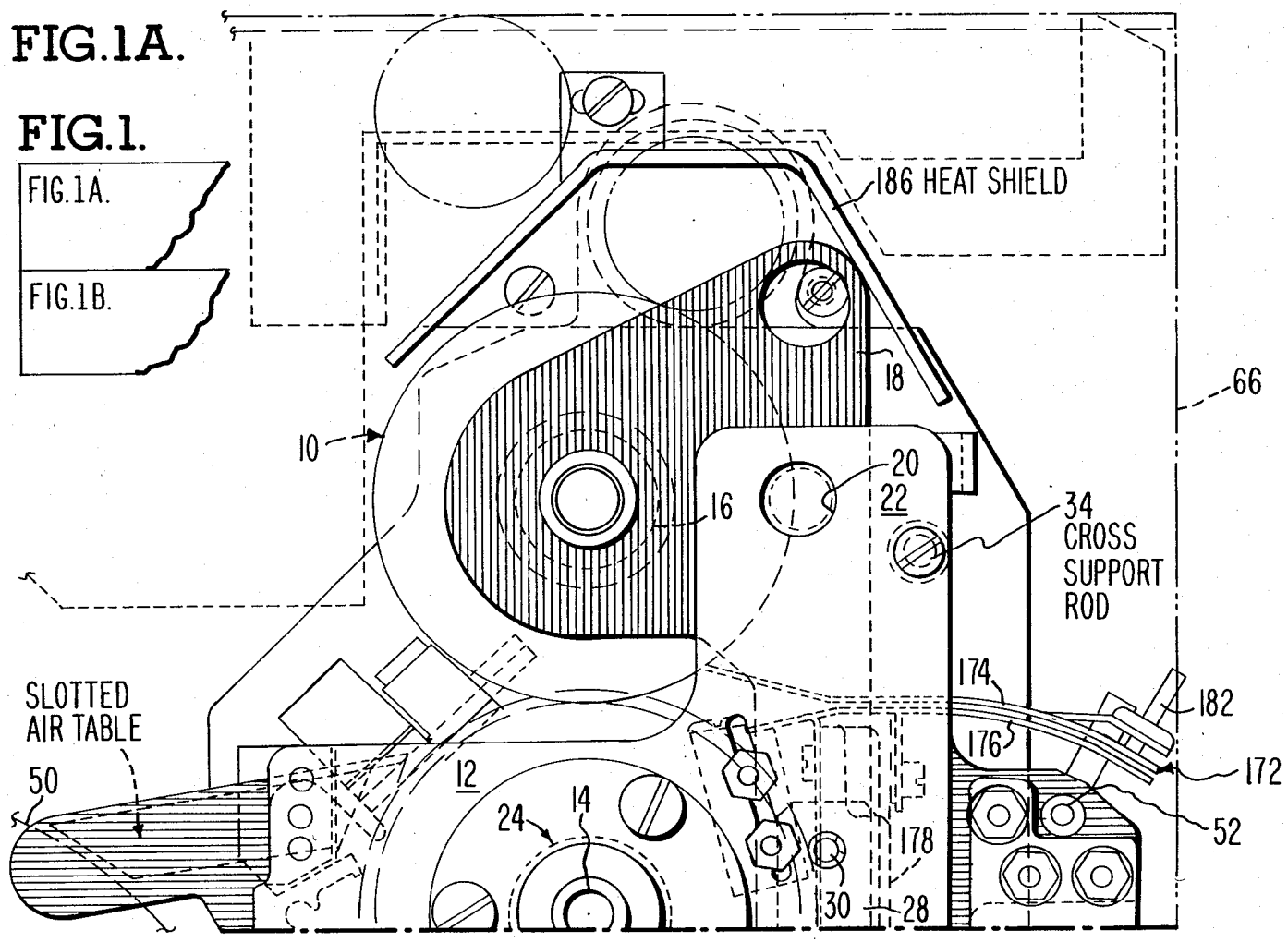
FIG. 1 illustrates the arrangement of the drawing FIGS. 1*a* and 1*b* depicting the present invention.
FIGS. 1*a* and 1*b* together illustrate a front end elevational view of the fuser assembly of the present invention.
Figure 1B:
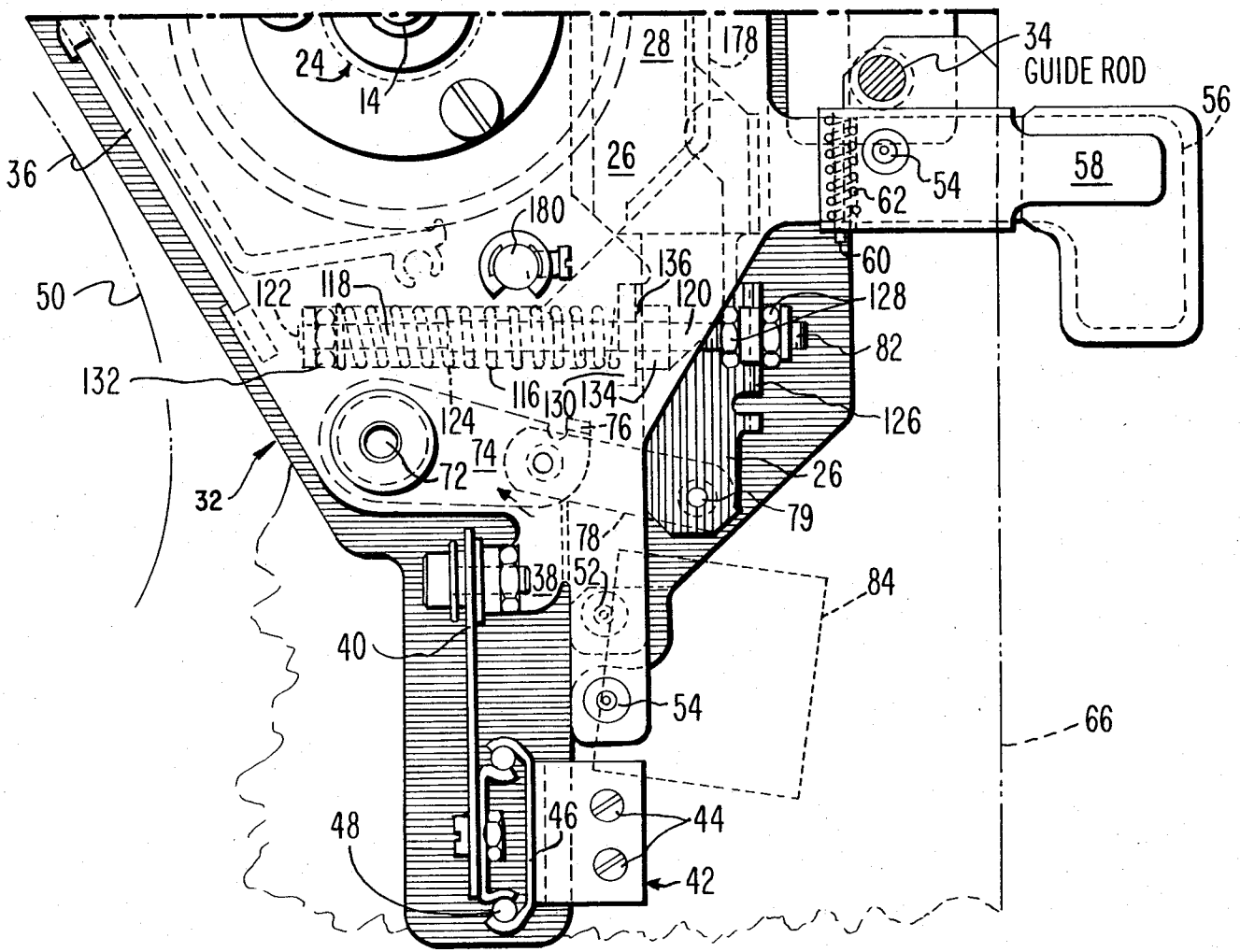

Lower heated idler roller 12 FIG. 1*b* is provided with a heating element 14 extending therethrough for purposes to be described shortly. Upper roller 10 is journaled in bearings 16 disposed in oppositely arranged vertical roller links 18 for rockable, pivotal movement about horizontal pivot pins 20 in oppositely disposed, parallel vertical side frames or plates 22. Idler roller 12 is journaled in bearings 24 in inboard and outboard (L-R) side plates 22 and is maintained in rolling surface contact with upper roller 10.

Figures 2, 2A, 2B:
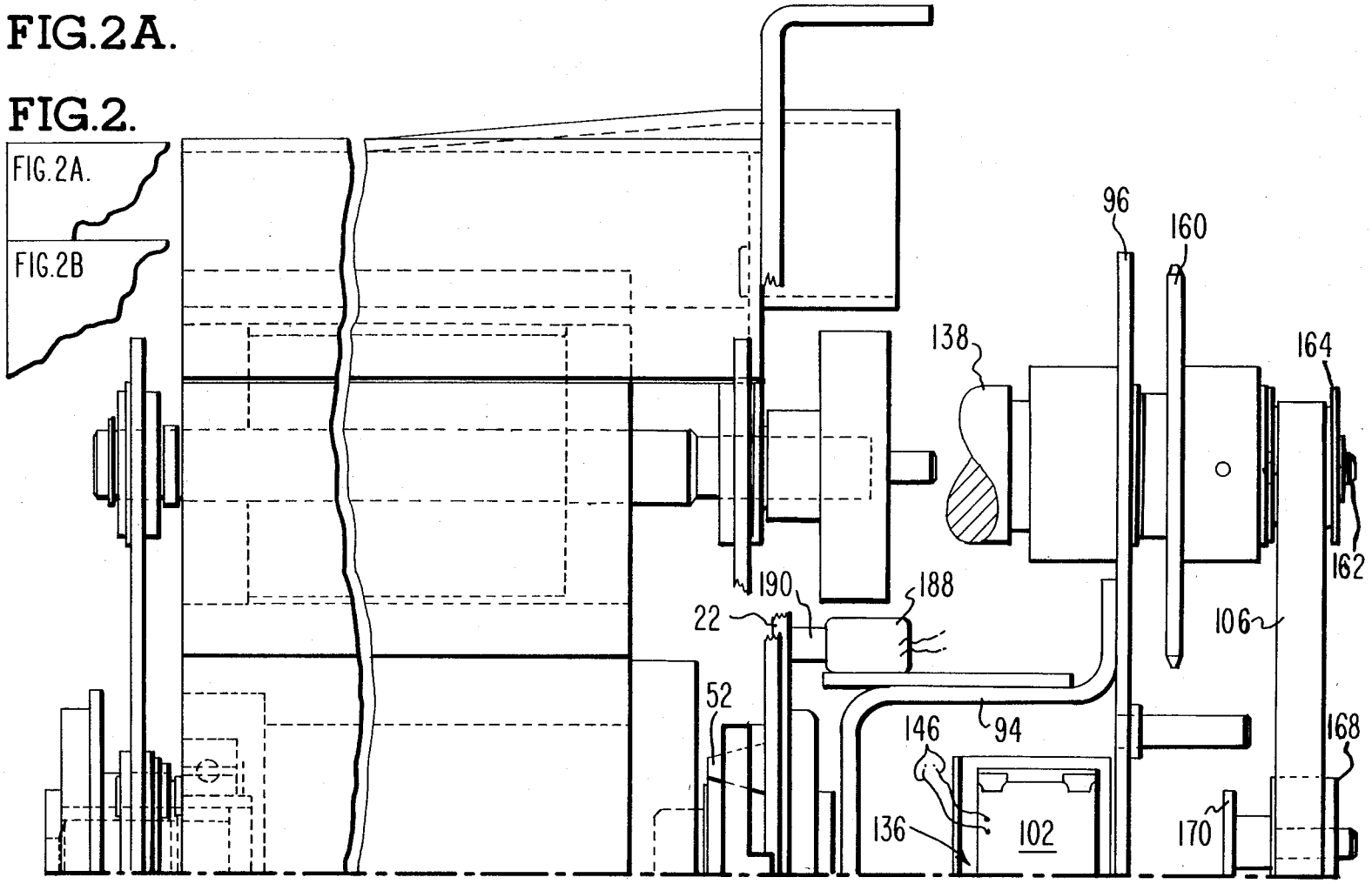
FIG. 2 illustrates the arrangement of the drawing FIGS. 2*a* and 2*b;*
FIGS. 2*a* and 2*b* together illustrate side elevational view of the present invention.
Figure 2B:
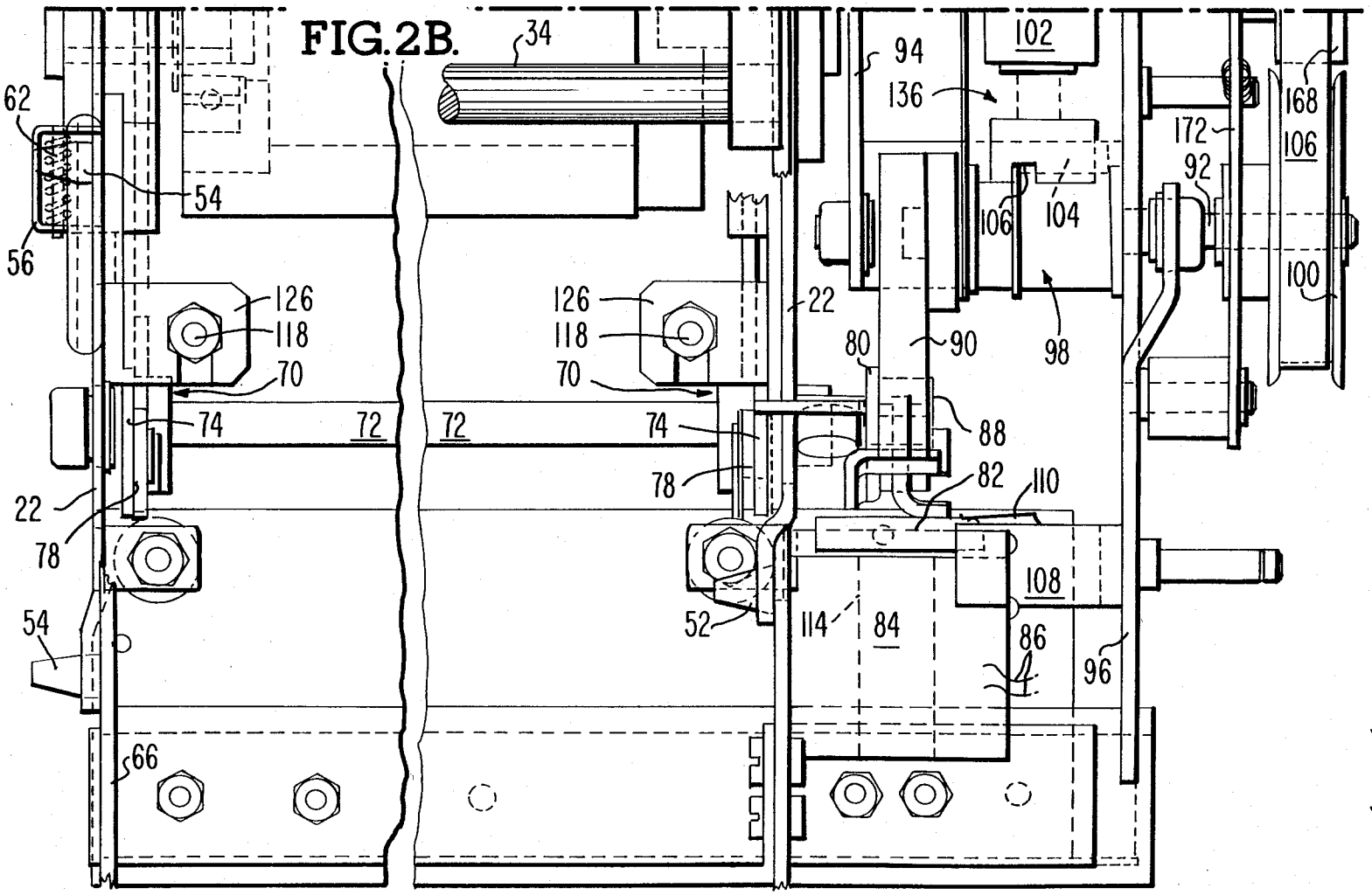

Left and right vertical spring links 26 are provided with integral upper U-shaped cross section members 28 FIGS. 2*a* and 3 and are pivotally coupled to roller link members 18 at their upper ends by pivot pins 30 and to a broken or dead center linkage assembly 32 FIGS. 1*b* and 4 at their lower ends as will be described in detail shortly herein. Right and left inboard and outboard side plates 22 are rigidly separated by means of upper and lower cross coupling rods or shafts 34—34 and at the front or left side FIG. 1*b* by a rigid extruded structural member 36.

The lower end of each side plate 22 is provided with a bent tab or tang 38, the end of which is bolted securely to the vertically disposed forwardly and rearwardly movable horizontal drawer slide member 40. The fixed portion 46 of the drawer slide 40 is attached to the base main frame by bolts 44 through brackets 42. Bearings 48, between the fixed and movable members 40 and 46, moving on a bearing guide bolted to member 40, enable the fuser assembly, as a modular unit, to move back and forth along the guide rail (cross rod) 34.

In order to accurately secure the fuser assembly in operative relation to the photo-optical drum 50 with which it is associated a plurality of alignment members are employed. As seen in FIGS. 1*a* and 1*b* an upper and lower inner, vertically offset pair of relatively short, tapered alignment pins 52—52, respectively, cooperate with an upper and lower outer vertically offset pair of tapered alignment pins 54—54 respectively together with rigid cross support guide rod 34 the four tapered pins 52 and 54 permit the assembly to be movable, forwardly and rearwardly, providing access for service, repair, maintenance and/or when necessary, and required, complete removal of the fuser from the base machine with which it is operably associated.

Figure 3:
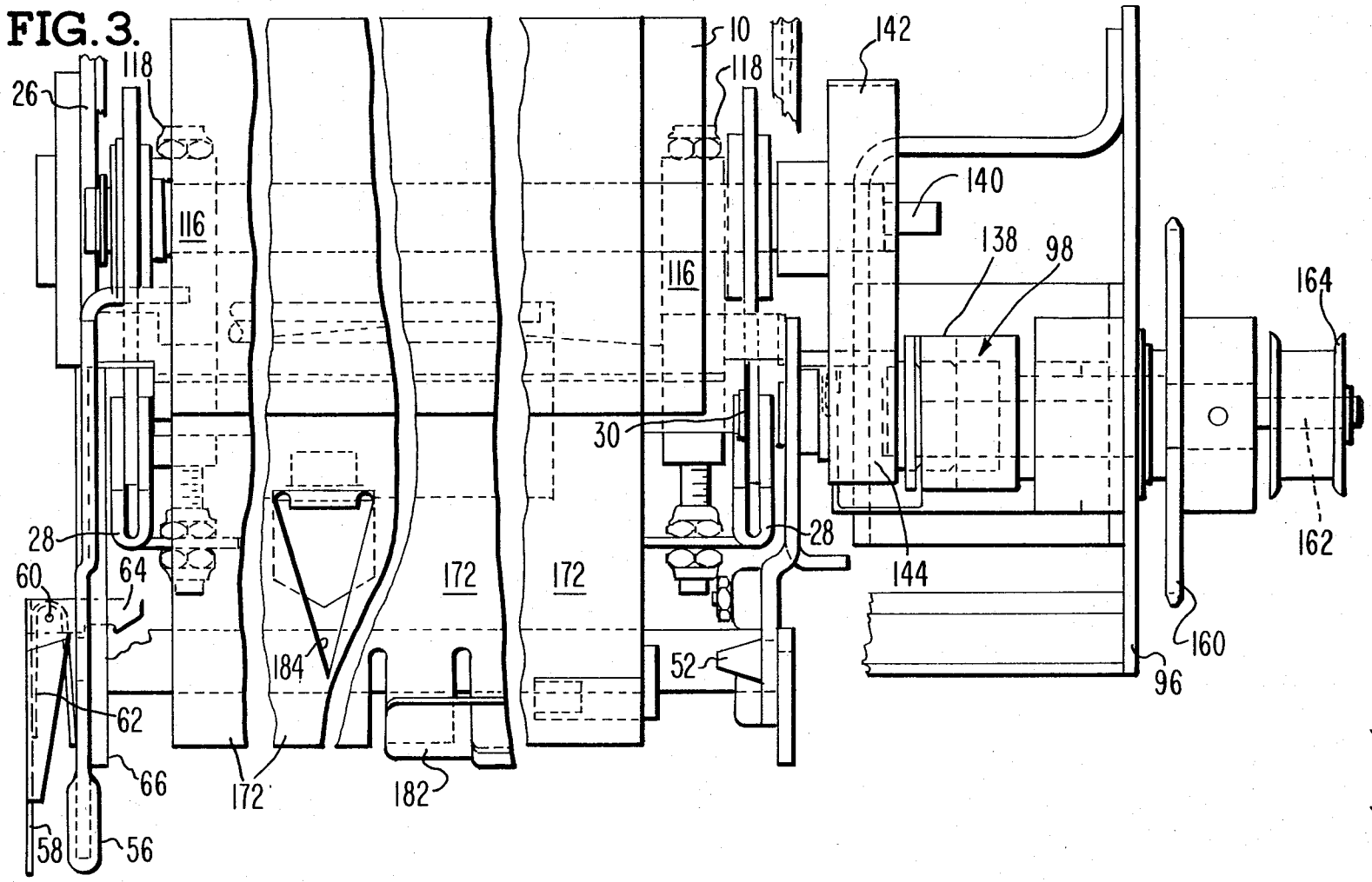
FIG. 3 is a partial top plan view of the present invention with parts broken away to accommodate the size of the physical hardware to the drawing sheets.

Integral with the external outboard side plate or frame 22, viewing the fuser from in front, is an integral, horizontally projecting handle member 56 (FIGS. 1*b* and 3). Extending slightly forwardly of handle 56 and overlying the upper portion thereof is a paddle shaped latch 58, hinged at the left end on a pivot pin 60 and biased forwardly i.e. latched, by means of a spring 62. The rearwardly extending, right angled portion of latch 58 is notched as at 64 FIG. 3 so as to catch i.e. latch, the edge of external vertical frame member 66 when in the latched or closed position shown.

The present invention is directed to automatic signal controlled means for engaging and disengaging the heated pressure roller 12 from the driver roller 10 and for maintaining the two rollers 10 and 12 under a preset pressure when in the engaged or driving condition. It has been determined that to provide good, clear, crisp, clean "no smudge" copy with ordinary paper stock both heat and pressure are required. A roller pressure of 100 lbs end of roller produces excellent copy under continuous usage.

However, loading the two rollers together and maintaining them in this condition for extended periods of non-rolling use may cause them to take a permanent set. The surfaces tend to become eccentric and "out-of-round". This produces poor copy as well as creating a host of associated problems.

The dead center linkage 32, as seen most clearly in FIG. 4, comprises a dead center linkage cross shaft 72 mounted for pivotal rocking movement between opposite side plates 22—22, as will be described shortly herein, and includes a pair of enlarged rear links 74, the forwardly extending outboard end of each one of which has a bent over tang 76. Members 74—74 are secured to and pivotally movable with cross shaft 72. A pair of smaller front links 78—78 are arcuately, pivotally connected to the forward end of respective rear links 74. The forward end of each front link 78 is rockably connected by pivot pin 79 to the lower end of a respective vertical spring link 26. The upper yoke of U-shaped end 28 of each link 26 surrounds the lower end of a respective L-shaped vertical roller link 18 as seen in FIGS. 2*a* and 4.

The inboard distal end i.e. toward the center of the assembly (right in FIG. 4) of dead center linkage cross shaft 72 is provided with a cam follower link 80 rockable therewith. The rightward end of link 80 is provided with a short vertical attachment post to which is secured the clapper 82 of control solenoid 84, energized over lines 86, for purposes to be described shortly herein. A cam follower roller 88 is rotatably disposed intermediate the ends of link 80 for rotatable engagement with an enlarged drive cam 90. A short cross shaft 92 FIG. 2*b* journaled between an angled support plate 94 and the inboard main frame member 96 carries a one revolution clutch 98 and an external drive pulley 100 at the out board end thereof. Electromagnet 102 has its clapper 104 engaging the stop collar 106 on shaft 92 effectively controlling the rotation of shaft 92. A microswitch 108 has its actuator 110 extending beneath a bent tang (not shown) secured to link 90, for purposes to be described shortly.

Figure 4:
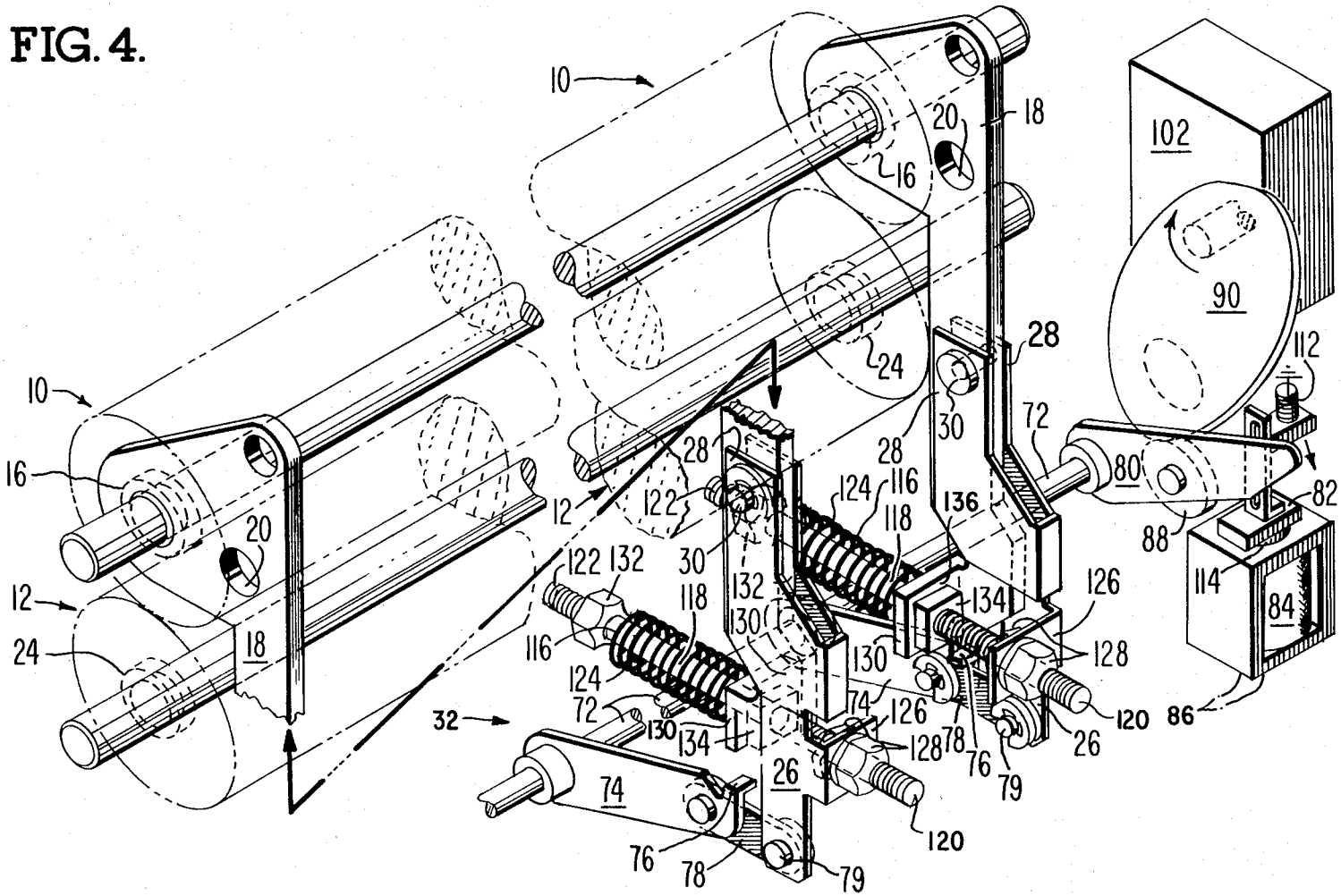
FIG. 4 is an isometric view of the fuser assembly embodying the present invention.
Figure 5:
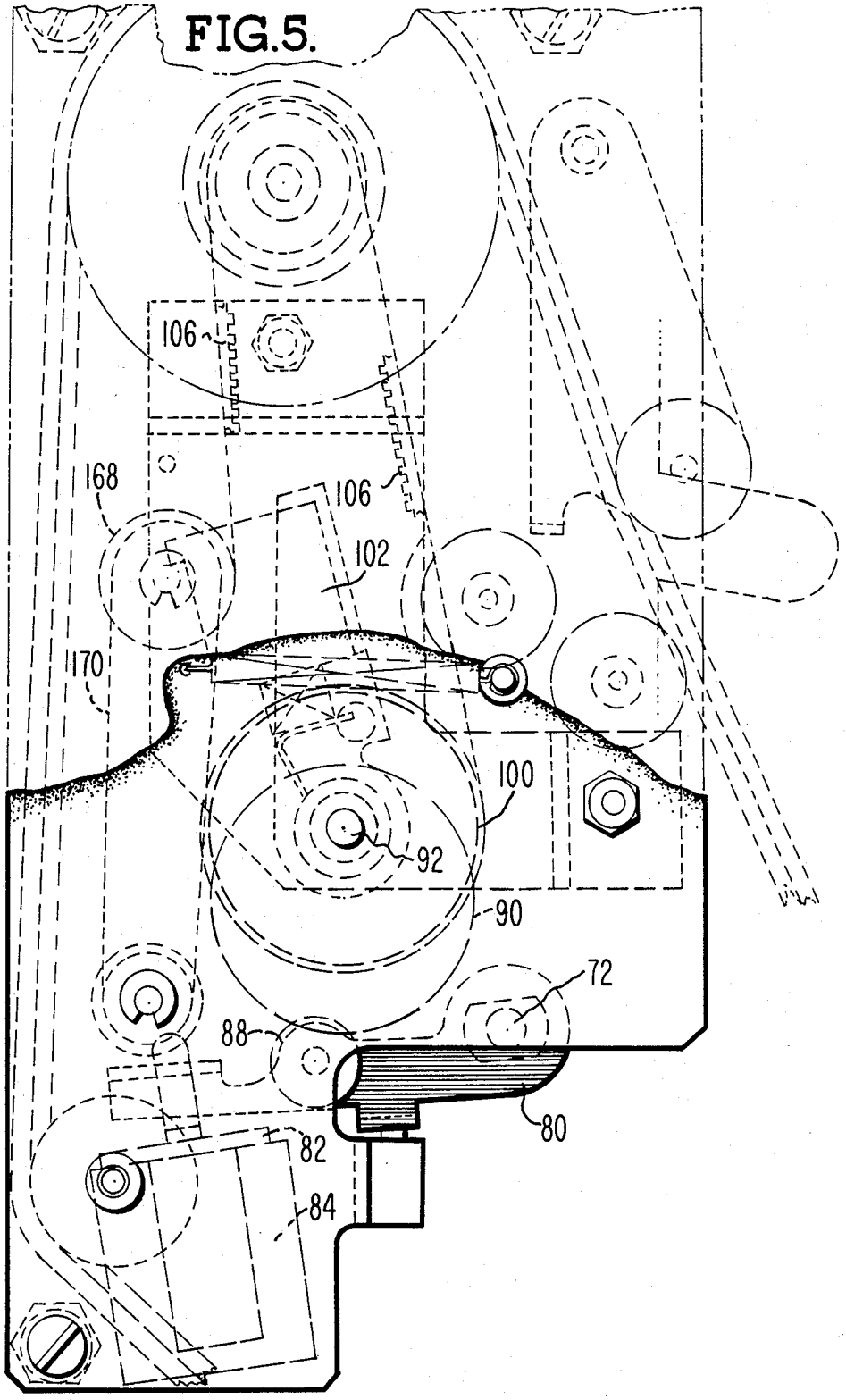
FIG. 5 is a schematic view from the rear of the apparatus.

From the foregoing it is readily apparent that clockwise (cw) rotation of dead center linkage shaft 72 by rotation of pulley 100 will rock dead center linkages 74 and 78 from an initial and upwardly angled position FIG. 4, to a substantially (although not completely) flat, horizontal position, simultaneously rocking spring links 28 and roller links 18 about the fixed pivot points 20 bringing upper driven roller 10 into surface contact with the lower heated roller 12. A retracting spring 112 for upper roller 10 is secured to the inboard side plate 22 and to the forward end of cam follower link 80. For separating the two rollers as will become apparent shortly.

Rotative movement of cam 90 engagable with follower roller 88 on link 80 which causes the (cw) movement of linkage 70 concurrently causes clapper 82 to seat against the pole piece 114 of solenoid 84. This movement brings upper movable roller 10 into contact with lower roller 12. Energization of solenoid 84 maintains the roller 10 in contact with roller 12. Deenergization of solenoid 84 enables the return spring 112 to retract roller 10 away from roller 12.

Mere surface contact however, between rollers 10 and 12, is insufficient for fusing the toner into the paper, (not shown). To produce the pressure required between rollers 10 and 12 a pair of oppositely disposed, adjustable force, regulator spring, roller tensioning members 116—116 are provided FIG. 1*b*. Each spring tensioning member 116 is seen to comprise an elongated spring shaft 118, the opposite ends of which are threaded, as at 120 and 122 while the central intermediate portion is smooth finished to retain a force regulator spring 124. Springs 124 are retained on shafts 118 at their extreme rightward ends by means of inwardly bent tangs 130 on depending members 18, and inner and outer nuts 132–134. The rightwardly extending end of each shaft 118, to the right of tangs 130, is adjustably disposed through a second tang 126 on the depending end of members 26. The adjusting nuts 132 permit the spring force to be easily adjusted and accurately maintained to produce approximately 100 pounds of force between rollers 10 and 12. A slight gap or space (0.035 to 0.040 in.) 136 FIG. 1*b* between tang 130 and the nut 134 on shaft 118 indicates that the desired force measurement is provided.

Figure 6:
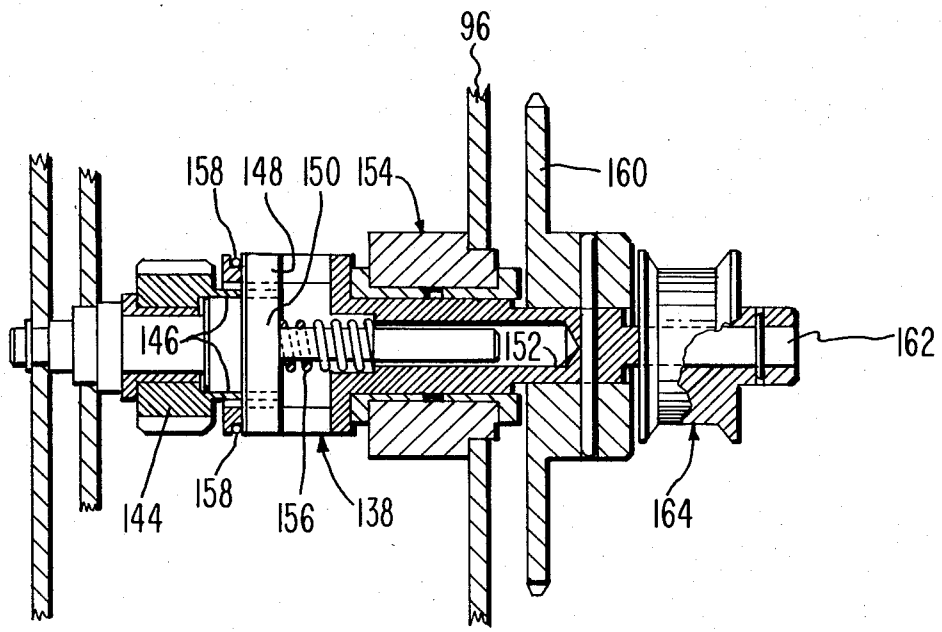
FIG. 6 is an illustration of the drive coupling between the fixed and movable portions of the fuser assembly.

In order to fit the requirements that the modular, fuser assembly be demountably, slideably, retractably, moveable from the base machine for service, repair and maintenance, a novel coupling assembly 138 is employed as part of the present combination. As seen in FIG. 3, the inboard end of shaft 140, which rotatably supports rockable pressure roller 10, carries an enlarged toothed wheel 142 in rolling engagement with a smaller pinion gear 144 rotatably secured to the outer side plate 22. Pinion gear 144 FIG. 6 is provided with a castellated external edge, the notches or slots 146, of which are adapted to engage the cross arm 148 of a key 150, such as a woodruff key. Key 150 is slidably retained in an elongated slot 152 in a coupler 138 against the tension of coil spring 156 by means of a clamp ring 158. Coupler 138 is rotatably mounted in and extends through vertical wall 96 of the base machine. The outboard end of coupler 138 carries an input drive sprocket wheel 160 which is pinned to the central shaft 162 and is driven from the base machine drive by means of a chain (not shown). A toothed pulley 164 on the outboard end of shaft 162 acts as a power takeoff for toothed pulley 100 FIG. 2*a* via belt 106 FIG. 2*b* and tension roller 168 carried by spring biased rockable idler arm 170 FIG. 5.

As earlier mentioned herein the fuser roller i.e. hot roller 12 is employed to fuse the toner particles (not shown) to the paper sheet items (not shown) as the latter are drawn through the fuser assembly. To provide the required high heat, heating element 14 comprises a tungsten filament lamp (not shown) disposed in a quartz envelope (not shown) which is fixedly disposed within a cylindrical bore in heated roller 12. An electrical connector (not shown) at one end of the lamp connects the lamp with a suitable source of electrical potential (not shown).

Because of the possibility of sheet item jams, which, while minimal, can occur without warning, a movable sheet item guideway or throat 172, FIGS. 1*a* and 3, is provided. The arcuately curved upper and lower sheet metal item guide plates or members 174–176 are secured to an insulation housing 178, the lower portion of which is mounted to a rockable cross shaft 180 FIG. 1*b*. The surface of the insulation housing 178 carries a polished heat reflective member (not shown) which acts to contain the high heat developed by the heater 14. So as to permit the operator to have immediate access to the sheet items should a jam occur, the throat or guideway is pivotally movable clockwise (cw) biased by a return spring (not shown). An insulating handle 182 FIG. 1*a* enables the operator to rock the guideway (cw) against the urging of the return spring thus exposing the pathway of the items for manual removal of any jams. Visual access openings effectively permit the operator to view the item passageway for item monitoring.

A top cover heat shield 186 FIG. 1*a* of insulating plastic is secured over the top of the fuser assembly and is attached to the rear main frame of the base machine so that it remains fixed even though the fuser assembly is withdrawn from the machine frame as for service, repair and maintenance. An interlock microswitch 188 has its actuator 190 extending forwardly (leftwardly FIG. 2) so as to contact-engage the rear wall structure 22 of the slidably movable portion of the fuser assembly. Closure of the switch contacts allows current to flow through wires 146 to coil 102 actuating clutch 136 whenever current is supplied by base machine. The resulting rotation of the cam 90 and the follower link 80 causes switch actuator 110 to be depressed closing the contacts of switch 108 thereby indicating that the fusing apparatus is functioning.

OPERATION

With the printer-copier electrographic apparatus in operation the cam 90 has been rotated by the drive member 100 so as to close the rollers 10 and 12 together and the electromagnet 84 has now been energized so as to hold the clapper 82 against the pole piece 114 which in turn means that the 100 pound force exerted at opposite sides of the two rollers is now effective and the rollers are in driving engagement. Sheet items can now be fed through the device and fused in the ordinary course. With the 100 pound force on each roller and with paper between the two rollers, it is very difficult it not impossible to release the paper should a jam occur or should the machine shut down. Of course, it is possible to pull the fuser out of the printer, which in fact would cause the rollers to disengage. But, because of the relatively high pressure another problem presents itself and that is that the rollers take a permanent set if they are held together in one spot for a relatively long time. So, in order to make it easier and more efficient to remove the paper if there happens to be a jam or a shut down of the mechanism, the dead center cam and linkage automatically releases the 100 pound force, and this release will occur whether there is a jam which stops the machine or whether in fact the machine is stopped for some other purposes.

If the machine stops for any reason a signal to the solenoid 84 releases the clapper 82 which because of the spring tension on the roller 10, the upper roller is immediately snapped away from the lower roller 12 and the two rollers separate. This mechanism is energized and deenergized by the software (not shown) in the machine base frame assembly. The timed delay for the "start-up" of the machine is also related to the software and the heat is kept on the heated roller 12 for a relatively short time after which the complete assembly is shut down.

It is noted that when the two rollers 10 and 12 touch, the over center cam 90 has been moved approximately forty-five degrees. At the point where the rollers touch the force between the two rollers increases rather dramatically and the compression springs provide the required 100 pound load. However, because of the moment arm with the one half inch pivot arm and the five inch pivot arm below, the springs are only required to exert about 33 pounds of force on the two links. The 100 pounds of force is developed on the opposite end. In addition the 33 pound force is further reduced by a longer link down to the dead center linkage. Thus, the cam 90 is not required to exert that much effort on the cam follower roller. As the dead center linkage approaches dead center the cam force becomes even lighter. The linkage is designed to stop just before dead center so that the electromagnet 84 is only required to hold the clapper 82 in position. Meanwhile, cam 90 continues back around 180 degrees and stops in the upright position where it is clear of the linkage and follower roller 88. At this point the cam follower 88 is being held down by the electromagnet. Once there is a jam the electromagnet is switched off and the cam follower can then "pop up". It is lifted by the spring 112 which serves to cause the two rollers to separate moving the upper roller away from the lower roller.

Assuming that it is necessary or required for the fuser assembly to be slid out of the main frame this is easily accomplished by unlatching the assembly and pulling the fuser outwardly toward the operator. This disengages the pinion gear 144 FIG. 6 from the woodruff key 150 while the remainder of the drive mechanism remains fixed at the back of the machine. With the fuser now slid out on the long slider rod it is possible to arcuately move the paper guide and insulating support arcuately downwardly to remove any paper which might become lodged within this area of the device.

By virtue of the regulator springs 116 a certain amount of clearance between the spring bolt head and the supporting tab is provided and this clearance, which is set once as an original adjustment, correctly guarantees that the correct spring force will be applied to the fuser rollers.

What we claim:

1. Apparatus for fusing toner in an elecrographic printing/copying apparatus comprising (a) a modular, demountable, toner fuser assembly comprising a pair of confronting roller members; means mounting one of said roller members for pivotal movement relative to the other of said roller members;

force regulator means interconnected to said mounting means including means for adjustably loading said rollers into engagement under a prescribed regulator loading force including means providing a visual indication of said loading force;

dead center linkage operably interconnecting said mounting means effective when moved in one direction to instantly separate said rollers;

(b) means for moving said dead center linkage from a nonload position wherein said rollers are out of engagement to a full load position wherein said load is effectively multiplied to the prescribed force with the rollers in tight engagement;

(c) signal activated means constraining said dead center linkage in said full load position; and (d) means for automatically retracting said dead center linkage and said roller members to a nonload position effectively permitting said toner fuser assembly to be mechanically disengaged and removably separated from said means for moving said dead center linkage and said signal activated means.

2. The invention in accordance with claim 1 wherein each of said roller members is resiliently covered with substantially identical material and wherein one of said roller members includes heater means extending axially thereof.

3. The invention in accordance with claim 1 wherein said roller member mounting means comprises oppositely disposed rockable links fixedly pivoted intermediate the ends with said one roller member rotatably disposed at one end of said rockable links and the opposite end of said links carrying said means for adjustably loading said rollers.

4. The invention in accordance with claim 3 wherein said adjustable loading means further comprises oppositely disposed, cantilever mounted, force regulator springs surrounding individual respective shaft members including means for increasing and decreasing the force on said springs effective to alter the load on said roller members.

5. The invention in accordance with claim 1 wherein said dead center linkage comprises a cross shaft interconnecting said roller member mounting means and including oppositely disposed pivoted links interconnecting said cross shaft and said mounting means and provided with control means operably engageable with said signal activated means.

6. The invention in accordance with claim 1 further including an indexing spring clutch separable from said toner fuser assembly and means operably coupled to said clutch effective to pivotally move said dead center linkage to bias said roller members into engagement under the prescribed load.

7. The invention in accordance with claim 1 wherein said signal activated means comprises an electromagnet and wherein the clapper of said electromagnet is operably coupled to said dead center linkage so that said electromagnet is capable of holding said dead center linkage under reduced force as the linkage approaches dead center.

8. The invention in accordance with claim 1 wherein said means for retracting said dead center linkage comprises a coiled spring on said fuser assembly.

9. The invention in accordance with claim 1 further including means integral with said mounting means providing means for visually checking the regulator loading force on said roller members.

10. The invention in accordance with claim 1 further including a cam member engagable with said dead center linkage and rotatable to bring said dead center linkage to a position just short of dead center effective to load said roller members together against the tension of said loading means and a coiled spring for releasably retracting said rollers apart in response to release of said signal activated means.

* * * * *